US010525308B2

(12) United States Patent
Sajima et al.

(10) Patent No.: US 10,525,308 B2
(45) Date of Patent: Jan. 7, 2020

(54) GOLF BALL

(71) Applicant: SUMITOMO RUBBER INDUSTRIES, LTD., Kobe-shi, Hyogo (JP)

(72) Inventors: Takahiro Sajima, Kobe (JP); Hironori Takihara, Kobe (JP); Toshiyuki Takubo, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 16/272,475

(22) Filed: Feb. 11, 2019

(65) Prior Publication Data

US 2019/0269975 A1 Sep. 5, 2019

(30) Foreign Application Priority Data

Mar. 1, 2018 (JP) ..... 2018-036558

(51) Int. Cl.
*A63B 37/00* (2006.01)
*A63B 37/14* (2006.01)

(52) U.S. Cl.
CPC ..... *A63B 37/0005* (2013.01); *A63B 37/0012* (2013.01); *A63B 37/0045* (2013.01); *A63B 37/0072* (2013.01); *A63B 37/0022* (2013.01); *A63B 37/0097* (2013.01)

(58) Field of Classification Search
CPC ..... A63B 37/0004; A63B 37/0005; A63B 37/0022; A63B 37/14; A63B 37/0097
See application file for complete search history.

(56) References Cited

U.S. PATENT DOCUMENTS 4,438,924 A * 3/1984 Carr ..... A63B 37/14 473/613
5,984,807 A * 11/1999 Wai ..... A63B 37/0003 264/241
6,066,054 A * 5/2000 Masutani ..... A63B 37/0003 473/374
6,155,935 A * 12/2000 Maruko ..... A63B 37/0003 473/361
6,213,897 B1 * 4/2001 Masutani ..... A63B 37/0003 264/255

(Continued)

FOREIGN PATENT DOCUMENTS

JP 2011-72776 A 4/2011
JP 2015-142599 A 8/2015

*Primary Examiner* — John E Simms, Jr.
(74) *Attorney, Agent, or Firm* — Birch, Stewart, Kolasch & Birch, LLP

(57) ABSTRACT

A golf ball has a main body 12 and a paint layer 10 positioned outside the main body 12. The main body 12 has a plurality of minute projections 18 on a surface thereof. The paint layer 10 has a thickness Tp of not less than 5 μm and not greater than 30 μm. Each minute projection 18 is embedded in the paint layer 10. An average value Hav of heights H of the minute projections 18 is not less than 0.5 μm and not greater than 80% of the thickness Tp. A ratio Pp of a sum of areas of all the minute projections 18 to a surface area of a phantom sphere of the golf ball is not less than 7%. An average value Dav of diameters D of the minute projections 18 is not less than 5 μm and not greater than 50 μm.

6 Claims, 6 Drawing Sheets

(56) References Cited

U.S. PATENT DOCUMENTS

| | | | | |
|---|---|---|---|---|
| 6,296,578 | B1 * | 10/2001 | Masutani | A63B 37/0003 473/367 |
| 6,508,726 | B1 * | 1/2003 | Yamagishi | A63B 37/0003 40/327 |
| 2010/0323817 | A1 * | 12/2010 | Molinari | A63B 37/0003 473/371 |
| 2011/0077106 | A1 | 3/2011 | Fitchett | |
| 2011/0106500 | A1 * | 5/2011 | Sato | A63B 37/0004 703/1 |
| 2012/0329577 | A1 * | 12/2012 | Anderl | A63B 37/0022 473/378 |
| 2013/0260916 | A1 * | 10/2013 | Tomita | A63B 37/0003 473/372 |
| 2015/0051017 | A1 * | 2/2015 | Sullivan | A63B 37/0003 473/374 |
| 2015/0182805 | A1 | 7/2015 | Sajima et al. | |
| 2015/0343269 | A1 * | 12/2015 | Bender | A63B 37/0039 473/374 |
| 2016/0332033 | A1 * | 11/2016 | Matsuyama | A63B 45/00 |
| 2018/0056136 | A1 * | 3/2018 | Mimura | A63B 37/0005 |
| 2018/0056138 | A1 * | 3/2018 | Sajima | A63B 37/0075 |

* cited by examiner

GOLF BALL

This application claims priority on Patent Application No. 2018-036558 filed in JAPAN on Mar. 1, 2018. The entire contents of this Japanese Patent Application are hereby incorporated by reference.

BACKGROUND OF THE INVENTION

Field of the Invention

The present invention relates to golf balls. Specifically, the present invention relates to golf balls each having a paint layer on the surface thereof.

Description of the Related Art

A golf ball has a main body and a paint layer positioned on the surface of the main body. The paint layer contributes to the appearance of the golf ball. The paint layer prevents dirt from adhering to the golf ball. Furthermore, the paint layer protects the main body.

JP2015-142599 discloses a golf ball having a surface with large roughness. The roughness can be formed by blasting or the like. The roughness enhances the aerodynamic characteristic of the golf ball due to a synergetic effect with dimples.

JP2011-72776 discloses a golf ball having a coating formed from a paint that contains particles. The particles enhance the aerodynamic characteristic of the golf ball due to a synergetic effect with dimples.

When a golf ball is hit with a golf club, the golf ball collides against the clubface of the golf club. When a golf ball falls, the golf ball collides against the ground. Due to these collisions, the paint may be peeled from the main body. This peeling impairs the appearance of the golf ball.

An object of the present invention is to provide a golf ball having a paint layer that is less likely to be peeled.

SUMMARY OF THE INVENTION

A golf ball according to the present invention has a main body and a paint layer positioned outside the main body and having a thickness Tp of not less than 5 μm and not greater than 30 μm. The main body has a plurality of minute projections on a surface thereof. Each minute projection is embedded in the paint layer. An average value Hav of heights H of these minute projections is not less than 0.5 μm. The average value Hav is not greater than 80% of the thickness Tp.

In the golf ball according to the present invention, the main body has the minute projections. Therefore, the main body and the paint layer are in contact with each other with a large area. The minute projections further serve as anchors to the paint layer. The paint layer is less likely to be peeled from the main body.

Preferably, a ratio Pp of a sum of areas of all the minute projections to a surface area of a phantom sphere of the golf ball is not less than 7%.

Preferably, an average value Dav of diameters D of the minute projections is not less than 5 μm and not greater than 50 μm.

Preferably, an average value Pav of pitches P each between a minute projection and another minute projection adjacent to this minute projection is not greater than 100 μm.

Preferably, a surface of the golf ball has an arithmetic average height Sa of not greater than 1.0 μm and a maximum height Sz of not greater than 0.5 μm.

Preferably, the average value Hav of the heights H of the minute projections is not greater than 50% of the thickness Tp of the paint layer.

DESCRIPTION OF THE PREFERRED EMBODIMENTS

The following will describe in detail the present invention based on preferred embodiments with appropriate reference to the drawings.

Figure 1:
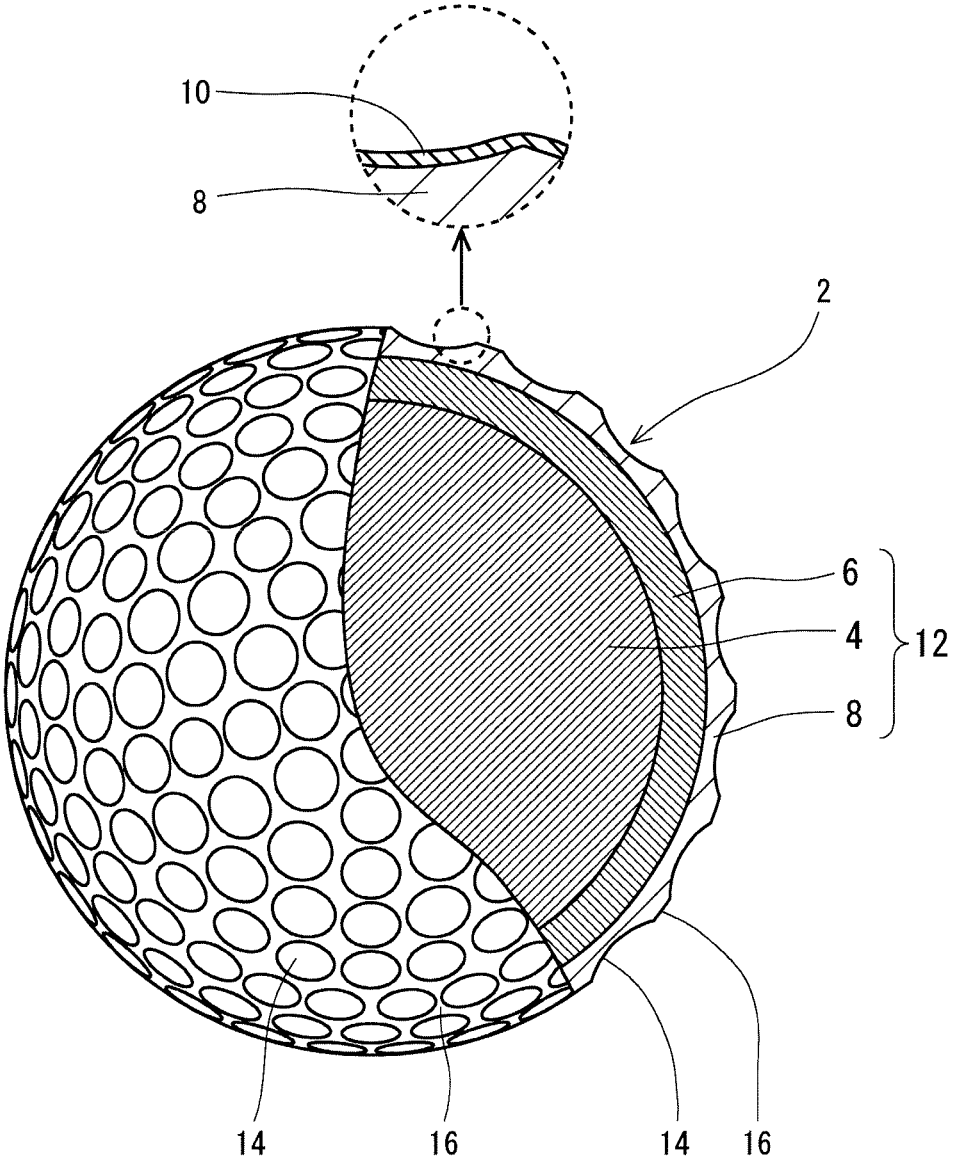
FIG. 1 is a cross-sectional view of a golf ball according to an embodiment of the present invention.

A golf ball 2 shown in FIG. 1 includes a spherical core 4, a mid layer 6 positioned outside the core 4, a cover 8 positioned outside the mid layer 6, and a paint layer 10 positioned outside this cover. The core 4, the mid layer 6, and the cover 8 are included in a main body 12 of the golf ball 2. The golf ball 2 has a large number of dimples 14 on the surface thereof. Of the surface of the golf ball 2, a part other than the dimples 14 is a land 16. The main body 12 may have a one-piece structure, a two-piece structure, a four-piece structure, a five-piece structure, or the like.

The golf ball 2 preferably has a diameter of not less than 40 mm and not greater than 45 mm. From the viewpoint of conformity to the rules established by the United States Golf Association (USGA), the diameter is particularly preferably not less than 42.67 mm. In light of suppression of air resistance, the diameter is more preferably not greater than 44 mm and particularly preferably not greater than 42.80 mm. The diameter of the golf ball 2 according to the present embodiment is 42.7 mm.

The golf ball 2 preferably has a weight of not less than 40 g and not greater than 50 g. In light of attainment of great inertia, the weight is more preferably not less than 44 g and particularly preferably not less than 45.00 g. From the viewpoint of conformity to the rules established by the USGA, the weight is particularly preferably not greater than 45.93 g.

Preferably, the core 4 is formed by crosslinking a rubber composition. Examples of the base rubber of the rubber composition include polybutadienes, polyisoprenes, styrene-butadiene copolymers, ethylene-propylene-diene copolymers, and natural rubbers. Two or more rubbers may be used in combination. In light of resilience performance, polybutadienes are preferable, and high-cis polybutadienes are particularly preferable.

The core 4 may be formed from a resin composition. The core 4 may be formed from a mixture of a rubber composition and a resin composition. A resin composition that will be described later for the mid layer 6 or the cover 8 can be used for the core 4.

The rubber composition of the core 4 includes a co-crosslinking agent. Examples of preferable co-crosslinking agents in light of resilience performance include zinc acrylate, magnesium acrylate, zinc methacrylate, and magnesium methacrylate. The rubber composition preferably includes an organic peroxide together with a co-crosslinking agent. Examples of preferable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide.

The rubber composition of the core 4 may include additives such as a filler, sulfur, a vulcanization accelerator, a sulfur compound, an anti-aging agent, a coloring agent, a plasticizer, and a dispersant. The rubber composition may include a carboxylic acid or a carboxylate. The rubber composition may include synthetic resin powder or cross-linked rubber powder.

The core 4 has a diameter of preferably not less than 30.0 mm and particularly preferably not less than 38.0 mm. The diameter of the core 4 is preferably not greater than 42.0 mm and particularly preferably not greater than 41.5 mm. The core 4 may have two or more layers. The core 4 may have a rib on the surface thereof. The core 4 may be hollow.

The mid layer 6 is formed from a resin composition. A preferable base polymer of the resin composition is an ionomer resin. Examples of preferable ionomer resins include binary copolymers formed with an α-olefin and an α,β-unsaturated carboxylic acid having 3 to 8 carbon atoms. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. For the binary copolymer and the ternary copolymer, preferable α-olefins are ethylene and propylene, while preferable α,β-unsaturated carboxylic acids are acrylic acid and methacrylic acid. In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion.

Instead of an ionomer resin or together with an ionomer resin, the resin composition of the mid layer 6 may include another polymer. Examples of the other polymer include polystyrenes, polyamides, polyesters, polyolefins, and polyurethanes. The resin composition may include two or more polymers.

The resin composition of the mid layer 6 may include a coloring agent such as titanium dioxide, a filler such as barium sulfate, a dispersant, an antioxidant, an ultraviolet absorber, a light stabilizer, a fluorescent material, a fluorescent brightener, and the like. For the purpose of adjusting specific gravity, the resin composition may include powder of a metal with a high specific gravity such as tungsten, molybdenum, and the like.

The mid layer 6 has a thickness of preferably not less than 0.2 mm and particularly preferably not less than 0.3 mm. The thickness of the mid layer 6 is preferably not greater than 2.5 mm and particularly preferably not greater than 2.2 mm. The mid layer 6 has a specific gravity of preferably not less than 0.90 and particularly preferably not less than 0.95. The specific gravity of the mid layer 6 is preferably not greater than 1.10 and particularly preferably not greater than 1.05. The mid layer 6 may have two or more layers.

The cover 8 is formed from a thermoplastic resin composition, a thermosetting resin composition, or a mixture of both compositions. Preferably, the cover 8 is formed from a thermoplastic resin composition. Examples of the base polymer of the resin composition include ionomer resins, thermoplastic polyester elastomers, thermoplastic polyamide elastomers, thermoplastic polyurethane elastomers, thermoplastic polyolefin elastomers, and thermoplastic polystyrene elastomers. Ionomer resins are particularly preferable. Ionomer resins are highly elastic. The golf ball 2 having the cover 8 that includes an ionomer resin has excellent resilience performance. The golf ball 2 has excellent flight distance upon a shot with a driver. The ionomer resin described above for the mid layer 6 can be used for the cover 8.

An ionomer resin and another resin may be used in combination. In this case, in light of resilience performance, the ionomer resin is included as the principal component of the base polymer. The proportion of the ionomer resin to the entire base polymer is preferably not less than 50% by weight, more preferably not less than 70% by weight, and particularly preferably not less than 80% by weight.

The resin composition of the cover 8 may include a pigment. The resin composition can include an inorganic pigment and an organic pigment. Examples of the inorganic pigment include: red pigments such as iron oxide red ($Fe_2O_3$), red lead ($Pb_3O_4$), molybdenum red, and cadmium red; yellow pigments such as titanium yellow ($TiO_2$—$NiO$—$Sb_2O_3$), litharge ($PbO$), chrome yellow ($PbCrO_4$), yellow iron oxide ($FeO(OH)$), and cadmium yellow; and blue pigments such as cobalt blue ($CoO.Al_2O_3$), Prussian blue, and ultramarine blue. Examples of the organic pigment include azo pigments, phthalocyanine pigments, and perylene pigments. Azo pigments are preferable. Examples of azo pigments include pigment yellow 1, pigment yellow 12, pigment red 3, pigment red 57, and pigment orange 13.

The resin composition of the cover 8 may include a filler, a dispersant, an antioxidant, an ultraviolet absorber, a light stabilizer, a fluorescent material, a fluorescent brightener, and the like in an adequate amount.

The cover 8 has a thickness of preferably not less than 0.2 mm and particularly preferably not less than 0.3 mm. The thickness of the cover 8 is preferably not greater than 2.5 mm and particularly preferably not greater than 2.2 mm. The cover 8 has a specific gravity of preferably not less than 0.90 and particularly preferably not less than 0.95. The specific gravity of the cover 8 is preferably not greater than 1.10 and particularly preferably not greater than 1.05. The cover 8 may have two or more layers.

The paint layer 10 is formed from a resin composition. A typical base resin of the resin composition is a polyurethane. In the present embodiment, the paint layer 10 is colorless and transparent. The paint layer 10 may include a coloring agent.

The paint layer 10 preferably has a thickness Tp of not less than 5 μm and not greater than 30 μm. The paint layer 10 having a thickness Tp of not less than 5 μm contributes to the appearance of the golf ball 2. From this viewpoint, the thickness Tp is more preferably not less than 7 μm and particularly preferably not less than 8 μm. The golf ball 2 that has the paint layer 10 having a thickness Tp of not greater than 30 μm has excellent dimension accuracy of the dimples 14. From this viewpoint, the thickness Tp is more preferably not greater than 25 μm and particularly preferably not greater than 20 μm.

Figure 2:
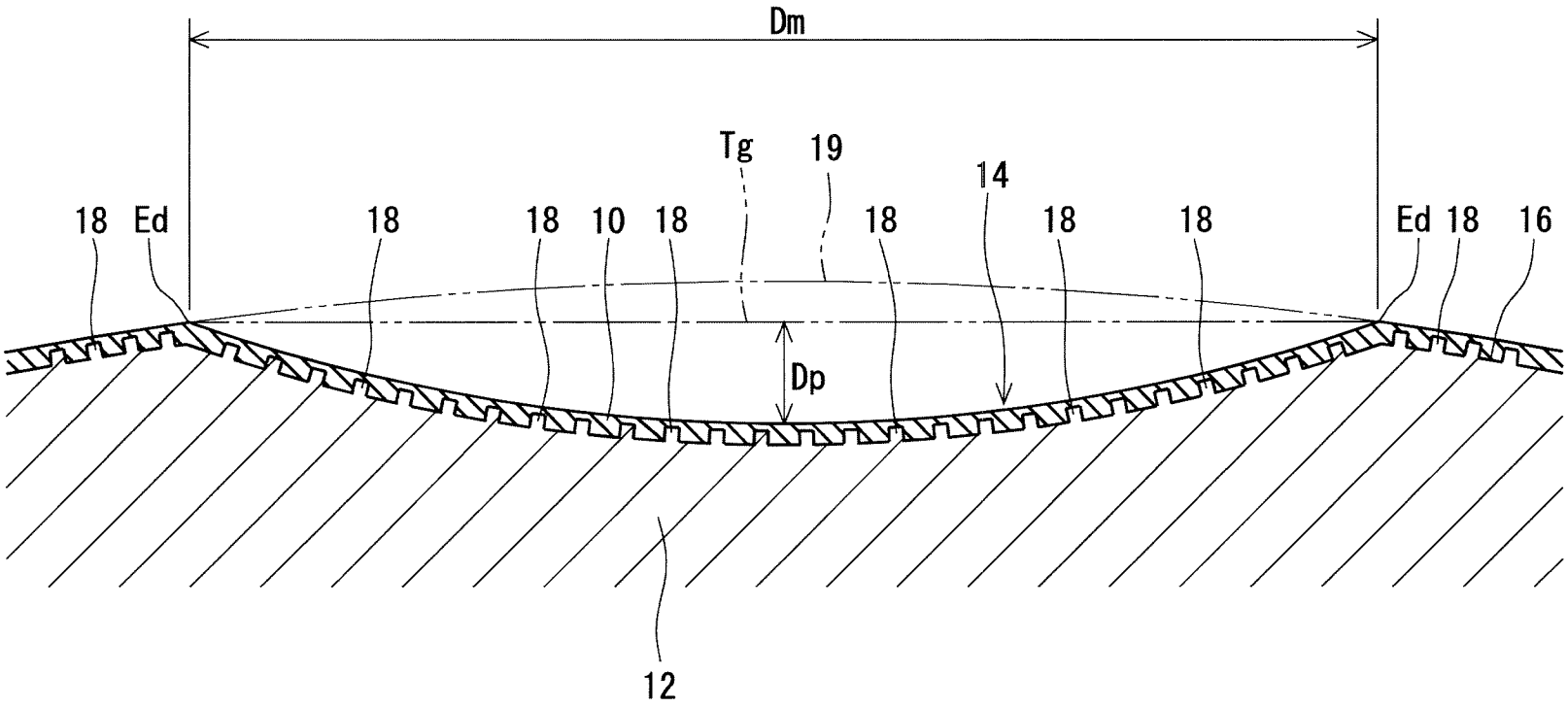
FIG. 2 is a partially enlarged cross-sectional view of the golf ball in FIG. 1.

FIG. 2 shows a cross section of the golf ball 2 along a plane passing through the central point of a dimple 14 and the central point of the golf ball 2. In FIG. 2, the top-to-bottom direction is the depth direction of the dimple 14. As shown in FIG. 2, the main body 12 has a large number of minute projections 18 on the surface thereof. In FIG. 2, an alternate long and two short dashes line 19 indicates a phantom sphere. The surface of the phantom sphere 19 is the surface of the golf ball 2 when it is postulated that no dimple 14 and no minute projection 18 exist. The diameter of the phantom sphere 19 is equal to the diameter of the golf ball 2. The dimple 14 is recessed from the surface of the phantom sphere 19. The land 16 coincides with the surface of the phantom sphere 19.

In FIG. 2, an arrow Dm indicates the diameter of the dimple 14. The diameter Dm is the distance between two tangent points Ed appearing on a tangent line Tg that is drawn tangent to the far opposite ends of the dimple 14. Each tangent point Ed is also the edge of the dimple 14. The edge Ed defines the contour of the dimple 14.

The diameter Dm of each dimple 14 is preferably not less than 2.0 mm and not greater than 6.0 mm. The dimple 14 having a diameter Dm of not less than 2.0 mm contributes to turbulization. From this viewpoint, the diameter Dm is more preferably not less than 2.5 mm and particularly preferably not less than 2.8 mm. The dimple 14 having a diameter Dm of not greater than 6.0 mm does not impair a fundamental feature of the golf ball 2 being substantially a sphere. From this viewpoint, the diameter Dm is more preferably not greater than 5.5 mm and particularly preferably not greater than 5.0 mm.

In the case of a non-circular dimple, a circular dimple 14 having the same area as that of the non-circular dimple is assumed. The diameter of the assumed dimple 14 can be regarded as the diameter of the non-circular dimple.

In FIG. 2, a double ended arrow Dp indicates the depth of the dimple 14. The depth Dp is the distance between the deepest part of the dimple 14 and the tangent line Tg. An average depth Dpav is calculated by summing the depths Dp of all the dimples 14 and dividing the sum of the depths Dp by the total number of the dimples 14. The average depth Dpav is preferably not less than 80 μm and not greater than 200 μm. With the golf ball 2 in which the average depth Dpav is not less than 80 μm, rising of the golf ball 2 during flight is suppressed. From this viewpoint, the average depth Dpav is more preferably not less than 100 μm and particularly preferably not less than 110 μm. With the golf ball 2 in which the average depth Dpav is not greater than 200 μm, dropping of the golf ball 2 during flight is suppressed. From this viewpoint, the average depth Dpav is more preferably not greater than 180 μm and particularly preferably not greater than 160 μm.

Figure 3:
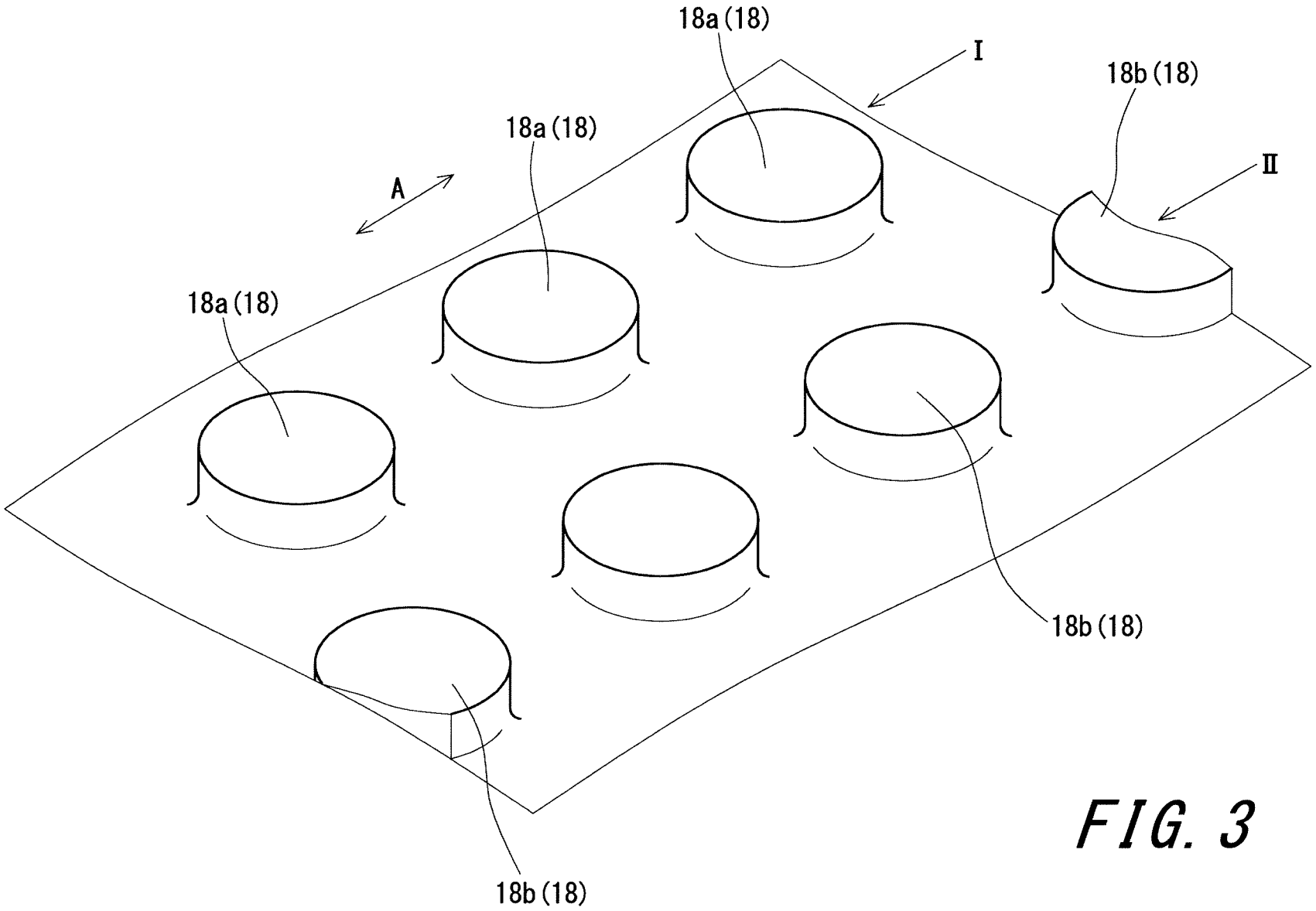
FIG. 3 is a partially enlarged perspective view of the surface of a main body of the golf ball in FIG. 1.

FIG. 3 is a partially enlarged perspective view of the surface of the main body 12 (in other words, the surface of the cover 8) of the golf ball 2 in FIG. 1. As shown in FIG. 3, the main body 12 has a large number of minute projections 18 on the surface thereof. Each minute projection 18 generally has a cylindrical shape. As is obvious from FIG. 2, the minute projections 18 are formed on the surfaces of the dimples 14 and also on the surface of the land 16. Each minute projection 18 stands outward in the radial direction of the golf ball 2. The minute projections 18 may be formed only on the surfaces of the dimples 14. The minute projections 18 may be formed only on the surface of the land 16.

FIG. 3 shows a plurality of minute projections 18*a* belonging to a first row I, and a plurality of minute projections 18*b* belonging to a second row II. The direction indicated by an arrow A in FIG. 3 is the direction in which the rows extend. In each row, the minute projections 18 are aligned at equal pitches. In other words, the minute projections 18 are regularly aligned. The minute projections 18*a*, which belong to the first row I, and the minute projections 18*b*, which belong to the second row II, are arranged in a zigzag manner. At a part of the surface of the golf ball 2, the minute projections 18 may be irregularly aligned.

Figure 4:
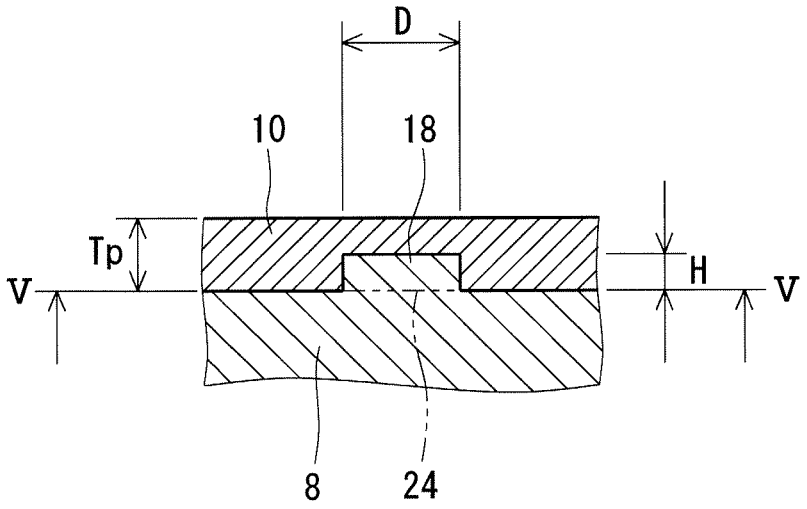
FIG. 4 is a partially enlarged cross-sectional view of the golf ball in FIG. 1.

FIG. 4 is a partially enlarged cross-sectional view of the golf ball 2 in FIG. 1. FIG. 4 shows the cover 8, which is a part of the main body 12, and the paint layer 10. FIG. 4 shows the minute projection 18. The minute projection 18 is covered with the paint layer 10. In other words, the minute projection 18 is embedded in the paint layer 10. The minute projection 18 stands outward in the radial direction of the golf ball 2. In FIG. 4, reference sign 24 indicates the bottom surface of the minute projection 18.

In the golf ball 2, since the main body 12 has the minute projections 18, the main body 12 and the paint layer 10 are in contact with each other with a large area. Each minute projection 18 further serves as an anchor to the paint layer 10. The paint layer 10 is less likely to be peeled from the main body 12.

When the golf ball 2 is hit with a golf club, energy is transmitted from the club to the ball due to collision of the ball with the clubface of the club. The minute projections 18 suppress loss of the energy. The golf ball 2 has excellent spin performance.

As described above, each minute projection 18 has a cylindrical shape. Therefore, the shape of the bottom surface 24 is a circle. In FIG. 4, an arrow D indicates the diameter of the bottom surface 24 and indicates the diameter of the minute projection 18. An average diameter Dav is calculated by summing the diameters D of all the minute projections 18 and dividing the sum of the diameters D by the number of the minute projections 18. The average diameter Dav is preferably not less than 5 μm and not greater than 50 μm. In the golf ball 2 in which the average diameter Dav is in the above range, the adhesion of the paint layer 10 to the main body 12 is high. In light of adhesion, the average diameter Dav is more preferably not less than 15 μm and particularly preferably not less than 20 μm. In light of adhesion, the average diameter Dav is more preferably not greater than 40 μm and particularly preferably not greater than 35 μm.

The area of each minute projection 18 is defined as the area of the bottom surface 24. The area Sp of the minute projection 18 shown in FIG. 4 can be calculated by the following mathematical formula.

$$Sp=(D/2)^2*n$$

The ratio Pp of the sum of the areas Sp of all the minute projections 18 to the surface area of the phantom sphere 19 of the golf ball 2 is preferably not less than 7%. With the golf ball 2 in which the ratio Pp is not less than 7%, the paint layer 10 is less likely to be peeled from the main body 12. From this viewpoint, the ratio Pp is preferably not less than 15% and particularly preferably not less than 20%. In light of ease of production of a mold for the golf ball 2, the ratio Pp is preferably not greater than 50%, more preferably not greater than 40%, and particularly preferably not greater than 35%.

Figure 5:
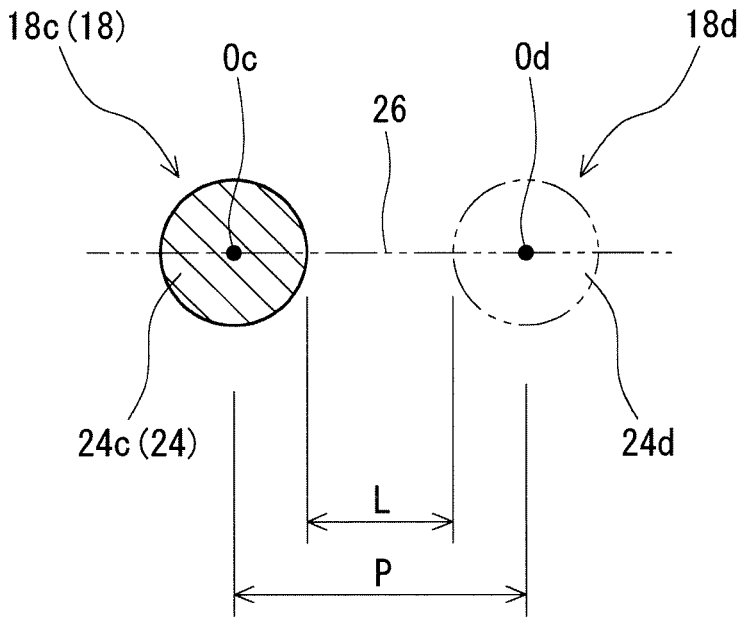
FIG. 5 is a cross-sectional view taken along the line V-V in FIG. 4.

FIG. 5 is a cross-sectional view taken along the line V-V in FIG. 4. FIG. 5 shows the bottom surface 24 of the minute projection 18. FIG. 5 shows a bottom surface 24*c* of a first minute projection 18*c* and also shows a bottom surface 24*d* of a second minute projection 18*d* by an alternate long and two short dashes line. The second minute projection 18*d* is adjacent to the first minute projection 18*c*. In FIG. 5, an alternate long and two short dashes line 26 represents a straight line passing through the center of gravity Oc of the bottom surface 24*c* of the first minute projection 18*c* and the center of gravity Od of the bottom surface 24*d* of the second minute projection 18*d*.

In FIG. 5, an arrow P indicates a pitch. The pitch P is the distance between the first minute projection 18*c* and the second minute projection 18*d* adjacent to the first minute projection 18*c*. The pitch P is the distance between the center of gravity Oc of the bottom surface 24*c* of the first minute projection 18*c* and the center of gravity Od of the bottom surface 24*d* of the second minute projection 18*d*. The "second minute projection 18*d* adjacent to the first minute projection 18*c*" is the minute projection 18*d* having a smallest distance L (described in detail later) to the first minute projection 18*c*, among the minute projections 18 present around the first minute projection 18*c*.

For each minute projection 18, one pitch P is determined. An average pitch Pav is calculated by summing the pitches P of all the minute projections 18 and dividing the sum of the pitches P by the number of the minute projections 18. The average pitch Pav is preferably not less than 10 μm. With the golf ball 2 in which the average pitch Pav is not less than 10 μm, the paint layer 10 is less likely to be peeled from the main body 12. From this viewpoint, the average pitch Pav is more preferably not less than 20 μm and particularly preferably not less than 25 μm. The average pitch Pav is preferably not greater than 100 μm. With the golf ball 2 in which the average pitch Pav is not greater than 100 μm, the paint layer 10 is less likely to be peeled from the main body 12. From this viewpoint, the average pitch Pav is more preferably not greater than 80 μm and particularly preferably not greater than 70 μm.

In FIG. 5, an arrow L indicates the distance between the first minute projection 18*c* and the second minute projection 18*d* adjacent to the first minute projection 18*c*. The distance L is a value obtained by subtracting the radius of the bottom surface 24*c* of the first minute projection 18*c* and the radius of the bottom surface 24*d* of the second minute projection 18*d* from the pitch P. For each minute projection 18, one distance L is determined. An average distance Lav is calculated by summing the distances L of all the minute projections 18 and dividing the sum of the distances L by the number of the minute projections 18. The average distance Lav is preferably not less than 5 μm and not greater than 50 μm. With the golf ball 2 in which the average distance Lav is not less than 5 μm, the paint layer 10 is less likely to be peeled from the main body 12. From this viewpoint, the average distance Lav is more preferably not less than 10 μm and particularly preferably not less than 15 μm. With the golf ball 2 in which the average distance Lav is not greater than 50 μm, the paint layer 10 is less likely to be peeled from the main body 12. From this viewpoint, the average distance Lav is more preferably not greater than 40 μm and particularly preferably not greater than 35 μm.

In FIG. 4, an arrow H indicates the height of the minute projection 18. The height H is measured along the radial direction of the golf ball 2. An average height Hav is calculated by summing the heights H of all the minute projections 18 and dividing the sum of the heights H by the number of the minute projections 18. The average height Hav is preferably not less than 0.5 μm. With the golf ball 2 in which the average height Hav is not less than 0.5 μm, the paint layer 10 is less likely to be peeled from the main body 12. From this viewpoint, the average height Hav is more preferably not less than 1.5 μm and particularly preferably not less than 2.0 μm.

The ratio of the average value Hav of the heights H of the minute projections 18 to the thickness Tp of the paint layer 10 is preferably not greater than 80%. With the golf ball 2 in which this ratio is not greater than 80%, the paint layer 10 is less likely to be peeled at the position immediately above the minute projection 18. From this viewpoint, this ratio is more preferably not greater than 60% and particularly preferably not greater than 50%. From the viewpoint that the paint layer 10 is less likely to be peeled, this ratio is preferably not less than 10%, more preferably not less than 15%, and particularly preferably not less than 20%.

The total number of the minute projections 18 is preferably not less than 10 thousand and not greater than 10 million. With the golf ball 2 in which this total number is not less than 10 thousand, the paint layer 10 is less likely to be peeled from the main body 12. From this viewpoint, this total number is more preferably not less than 20 thousand and particularly preferably not less than 50 thousand. A mold for the golf ball 2 in which this total number is not greater than 10 million is easily produced. From this viewpoint, this total number is more preferably not greater than 7 million and particularly preferably not greater than 5 million.

The surface of the golf ball 2 preferably has an arithmetic average height Sa of not greater than 1.0 μm. The golf ball 2 having an arithmetic average height Sa of not greater than 1.0 μm has excellent appearance. From this viewpoint, the arithmetic average height Sa is more preferably not less than 0.8 μm and particularly preferably not less than 0.6 μm.

The surface of the golf ball 2 preferably has a maximum height Sz of not greater than 0.5 μm. The golf ball 2 having a maximum height Sz of not greater than 0.5 μm has excellent appearance. From this viewpoint, the maximum height Sz is more preferably not greater than 0.4 μm and particularly preferably not greater than 0.3 μm.

The arithmetic average height Sa and the maximum height Sz are measured according to the standards of ISO-25178 with a laser microscope (for example, a non-contact type surface roughness/shape measuring instrument of Keyence Corporation). In the microscope, the surface of the golf ball 2 is scanned with a laser in an X direction and a Y direction. Through this scanning, unevenness data of the surface of the golf ball 2 is obtained. The arithmetic average height Sa and the maximum height Sz are calculated on the basis of a three-dimensional image obtained from the unevenness data. The measurement conditions are as follows.

Figure 6:
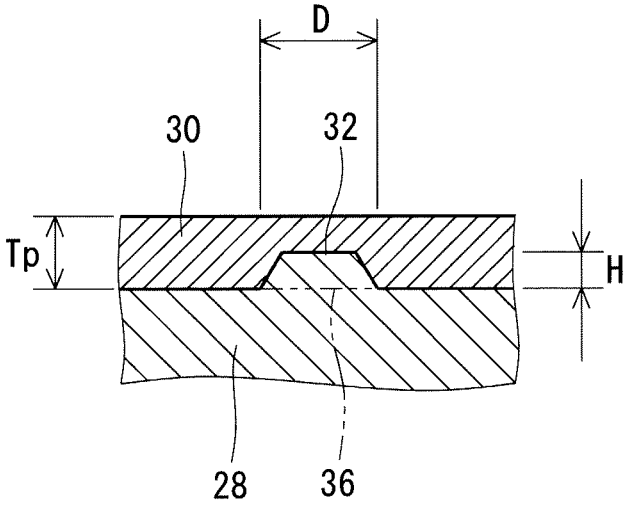
FIG. 6 is a cross-sectional view of a part of a golf ball according to another embodiment of the present invention.

Magnification: 1000
Measurement range X: 250 μm
Measurement range Y: 250 μm
Cutoff value: λc=0.25
Observation region: X=1024 pixels, Y=768 pixels
Total number of pixels: 786432 pixels FIG. 6 is a cross-sectional view of a part of a golf ball according to another embodiment of the present invention. FIG. 6 shows a cover 28 that is a part of a main body, and a paint layer 30. The cover 28 has minute projections 32 on the surface thereof. Each minute projection 32 is covered with the paint layer 30. In FIG. 6, reference sign 36 indicates the bottom surface of the minute projection 32.

Each minute projection 32 has a truncated cone shape. The specifications of this golf ball excluding the shape of the minute projection 32 are the same as the specifications of the golf ball 2 shown in FIGS. 1 to 5.

In this golf ball as well, the minute projections 32 contribute to adhesion of the paint layer 30.

The golf ball may have minute projections having a shape such as a cone shape, a prism shape, a truncated pyramid shape, a pyramid shape, a partial sphere shape, and the like.

EXAMPLES

Example 1

A rubber composition was obtained by kneading 100 parts by weight of a high-cis polybutadiene (trade name "BR- 730", manufactured by JSR Corporation), 27.4 parts by weight of zinc diacrylate, 5 parts by weight of zinc oxide, an appropriate amount of barium sulfate, 0.5 parts by weight of diphenyl disulfide, and 0.9 parts by weight of dicumyl peroxide. This rubber composition was placed into a mold including upper and lower mold halves each having a hemispherical cavity, and heated at 160° C. for 20 minutes to obtain a core with a diameter of 38.20 mm. The amount of barium sulfate was adjusted such that a core having a predetermined weight was obtained.

A resin composition was obtained by kneading 26 parts by weight of an ionomer resin (trade name "Himilan AM7337", manufactured by Du Pont-MITSUI POLYCHEMICALS Co., Ltd.), 26 parts by weight of another ionomer resin (trade name "Himilan AM7329", manufactured by Du Pont-MITSUI POLYCHEMICALS Co., Ltd.), 48 parts by weight of a styrene block-containing thermoplastic elastomer (trade name "Rabalon T3221C", manufactured by Mitsubishi Chemical Corporation), 4 parts by weight of titanium dioxide (A220), and 0.2 parts by weight of a light stabilizer (trade name "JF-90", manufactured by Johoku Chemical Co., Ltd.) with a twin-screw kneading extruder. The core was covered with this resin composition by injection molding to form a mid layer. The thickness of the mid layer was 1.00 mm.

A resin composition was obtained by kneading 47 parts by weight of an ionomer resin (trade name "Himilan 1555", manufactured by Du Pont-MITSUI POLYCHEMICALS Co., Ltd.), 46 parts by weight of another ionomer resin (trade name "Himilan 1557", manufactured by Du Pont-MITSUI POLYCHEMICALS Co., Ltd.), 7 parts by weight of a styrene block-containing thermoplastic elastomer (the aforementioned "Rabalon T3221C"), 4 parts by weight of titanium dioxide (A220), and 0.2 parts by weight of a light stabilizer (the aforementioned "JF-90") with a twin-screw kneading extruder. The sphere consisting of the core and the mid layer was placed into a final mold having a large number of pimples and minute recesses on its cavity face. The mid layer was covered with the resin composition by injection molding to form a cover. The thickness of the cover was 1.25 mm. Dimples having a shape that is the inverted shape of the pimples were formed on the cover. Furthermore, minute projections having a shape that is the inverted shape of the minute recesses were formed on the cover.

A clear paint including a two-component curing type polyurethane as a base material was applied to this cover to obtain a golf ball of Example 1 with a diameter of about 42.7 mm and a weight of about 45.6 g. The golf ball has a large number of minute projections on the surface of the main body thereof. The specifications of these minute projections are shown in Table 1 below.

Examples 2 to 7 and Comparative Examples 1 to 4

Golf balls of Examples 2 to 7 and Comparative Examples 1 to 4 were obtained in the same manner as Example 1, except the final mold was changed and minute projections having specifications shown in Tables 1 to 3 below were formed. The golf ball according to Comparative Example 4 does not have any minute projections.

[Adhesion]

A golf ball was immersed in water and kept for 1 week. The golf ball was caused to collide against a metal plate at a speed of 45 m/s. The number of collisions was 50. A golf player played three rounds with this golf ball. After the play, the appearance of the golf ball was visually observed and categorized on the basis of the following criteria.

A: The paint layer is not peeled at all.
B: The paint layer is slightly peeled.
C: The paint layer is significantly peeled.
D: The paint layer is extremely peeled.

The results are shown in Tables 1 to 3 below.

TABLE 1

| | Example 1 | Example 2 | Example 3 | Compa. Example 1 |
|---|---|---|---|---|
| Dav (μm) | 25 | 25 | 25 | 25 |
| Pav (μm) | 50 | 50 | 50 | 50 |
| Pp | 22.7% | 22.7% | 22.7% | 22.7% |
| Hav (μm) | 1.0 | 4.0 | 7.0 | 9.0 |
| Tp (μm) | 10 | 10 | 10 | 10 |
| Hav/Tp | 10% | 40% | 70% | 90% |
| Adhesion | C | A | B | D |

TABLE 2

| | Compa. Example 2 | Example 4 | Example 5 | Example 6 |
|---|---|---|---|---|
| Dav (μm) | 25 | 15 | 5 | 40 |
| Pav (μm) | 50 | 30 | 20 | 80 |
| Pp | 22.7% | 22.7% | 5.7% | 22.7% |
| Hav (μm) | 2.0 | 4.0 | 4.0 | 4.0 |
| Tp (μm) | 4 | 10 | 10 | 10 |
| Hav/Tp | 50% | 40% | 40% | 40% |
| Adhesion | D | A | C | B |

TABLE 3

| | Example 7 | Compa. Example 3 | Compa. Example 4 |
|---|---|---|---|
| Dav (μm) | 25 | 60 | — |
| Pav (μm) | 95 | 120 | — |
| Pp | 6.3% | 22.7% | 0% |
| Hav (μm) | 4.0 | 4.0 | — |
| Tp (μm) | 10 | 10 | 10 |
| Hav/Tp | 40% | 40% | 0% |
| Adhesion | C | D | D |

As shown in Tables 1 to 3, the golf ball of each Example has excellent adhesion of the paint layer. From the evaluation results, advantages of the present invention are clear.

The minute projections are applicable to golf balls having various structures such as a one-piece golf ball, a two-piece golf ball, a four-piece golf ball, a five-piece golf ball, a six-piece golf ball, a thread-wound golf ball, and the like in addition to a three-piece golf ball. The above descriptions are merely illustrative examples, and various modifications can be made without departing from the principles of the present invention.

What is claimed is:

1. A golf ball comprising a main body and a paint layer positioned outside the main body and having a thickness Tp of not less than 5 μm and not greater than 30 μm, wherein the main body has a plurality of minute projections on a surface thereof, each minute projection is embedded in the paint layer, and an average value Hav of heights H of these minute projections is not less than 0.5 μm and not greater than 80% of the thickness Tp.

2. The golf ball according to claim 1, wherein a ratio Pp of a sum of areas of all the minute projections to a surface area of a phantom sphere of the golf ball is not less than 7:100.

3. The golf ball according to claim 1, wherein each minute projection has a circular base and wherein an average value Dav of diameters D of the bases of the minute projections is not less than 5 μm and not greater than 50 μm.

4. The golf ball according to claim 1, wherein an average value Pav of pitches P each between a minute projection and another minute projection adjacent to this minute projection is not greater than 100 μm.

5. The golf ball according to claim 1, wherein a surface of the golf ball has an arithmetic average height Sa of not greater than 1.0 μm and a maximum height Sz of not greater than 0.5 μm.

6. The golf ball according to claim 1, wherein the average value Hav of the heights H of the minute projections is not greater than 50% of the thickness Tp of the paint layer.

* * * * *